US011812910B2

(12) United States Patent
Ross et al.

(10) Patent No.: US 11,812,910 B2
(45) Date of Patent: Nov. 14, 2023

(54) DISHWASHING APPLIANCES AND METHODS FOR ADDRESSING OBSTRUCTION THEREIN

(71) Applicant: Haier US Appliance Solutions, Inc., Wilmington, DE (US)

(72) Inventors: Christopher Brandon Ross, Louisville, KY (US); Kyle Edward Durham, Louisville, KY (US); Matthew David Mersch, Louisville, KY (US)

(73) Assignee: HAIER US APPLIANCE SOLUTIONS, INC., Wilmington, DE (US)

( * ) Notice: Subject to any disclaimer, the term of this patent is extended or adjusted under 35 U.S.C. 154(b) by 2 days.

(21) Appl. No.: 17/482,974

(22) Filed: Sep. 23, 2021

(65) Prior Publication Data

US 2023/0085650 A1 Mar. 23, 2023

(51) Int. Cl.
*A47L 15/42* (2006.01)
*A47L 15/00* (2006.01)

(52) U.S. Cl.
CPC ..... *A47L 15/0023* (2013.01); *A47L 15/4225* (2013.01); *A47L 15/4244* (2013.01); *A47L 2401/09* (2013.01); *A47L 2401/14* (2013.01); *A47L 2501/01* (2013.01)

(58) Field of Classification Search
None
See application file for complete search history.

(56) References Cited

U.S. PATENT DOCUMENTS

| | | | | |
|---|---|---|---|---|
| 6,887,318 | B2 | 5/2005 | Bashark | |
| 9,192,280 | B2 | 11/2015 | Burrows | |
| 9,565,987 | B2 | 2/2017 | Defilippi | |
| 2003/0008477 | A1 | 1/2003 | Kang | |
| 2019/0167066 | A1* | 6/2019 | Durham | A47L 15/4225 |
| 2019/0174990 | A1* | 6/2019 | Durham | A47L 15/4225 |
| 2019/0357749 | A1 | 11/2019 | Persson | |
| 2020/0352408 | A1 | 11/2020 | Durham | |

FOREIGN PATENT DOCUMENTS

| | | | |
|---|---|---|---|
| EP | 2382908 | * | 11/2011 |
| KR | 100640853 | B1 | 11/2006 |
| WO | WO2020023433 | * | 1/2020 |

* cited by examiner

*Primary Examiner* — Mikhail Kornakov
*Assistant Examiner* — Ryan L Coleman
(74) *Attorney, Agent, or Firm* — Dority & Manning, P.A.

(57) ABSTRACT

Dishwashing appliances and methods, as provided herein, may include features or steps such as performing a drain cycle; detecting a pressure (P1) during an activation period of the drain cycle; comparing the pressure to a first predetermined pressure limit; comparing the pressure to a second predetermined pressure limit; determining a target fill value based on a difference between a normal fill volume and a fluid volume corresponding to P1; and initiating a fill cycle based on the target fill value.

18 Claims, 7 Drawing Sheets

DISHWASHING APPLIANCES AND METHODS FOR ADDRESSING OBSTRUCTION THEREIN

FIELD

The present subject matter relates generally to dishwashing appliances, and more particularly to features and methods for addressing obstructions or clogs in a dishwashing appliance.

BACKGROUND

Dishwashing appliances generally include a tub that defines a wash chamber. Rack assemblies can be mounted within the wash chamber of the tub for receipt of articles for washing. Multiple spray assemblies can be positioned within the wash chamber for applying or directing wash fluid (e.g., water, detergent, etc.) towards articles disposed within the rack assemblies in order to clean such articles. Dishwashing appliances are also typically equipped with one or more pumps, such as a circulation pump or a drain pump, for directing or motivating wash fluid from the wash chamber (e.g., to the spray assemblies or an area outside of the dishwashing appliance).

Conventional dishwashing appliances include one or more filter assemblies for filtering the wash fluid exiting the wash chamber. Depending upon the level of soil upon the articles, fluids used during wash and rinse cycles will become contaminated with sediment (e.g., soil, food particles, etc.) in the form of debris or particles that are carried with the fluid. In order to protect the pump and recirculate the fluid through the wash chamber, it is beneficial to filter the fluid so that relatively clean fluid is applied to the articles in the wash chamber and materials are removed or reduced from the fluid supplied to the pump. As a result, a filter assembly may be provided within or below a sump portion of the tub.

Over time and after repeated use of a dishwashing appliance, sediment may accumulate within a filter assembly. If left unaddressed, the accumulation may lead to obstructions or clogs in the sump, pump, or another portion of a fluid flow path. This may produce undesirable noises, impair appliance performance, and may even damage the dishwashing appliance. It may be useful for a filter assembly to be regularly cleaned, but this can be difficult for a user. Often, users are unaware of the recommended cleaning schedule for the filter assembly. Moreover, even if a recommended schedule for cleaning is known, a particular dishwasher may deviate from the schedule. In other words, the filter assembly may become dirty faster or slower than predicted by the schedule.

Conventional dishwashing appliances may include methods or structures for determining obstructions at a filter, which may indicate to a user to perform a manual operation to remove the obstruction. However, such methods and structures may generate repeated fault signals, false error codes, or require repeated manual operation, each of which may be undesired for a user.

Accordingly, dishwashing appliances and methods for operation that may detect obstruction conditions, prevent failed drains, prevent unnecessary fault signals, and mitigate false error codes would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method for operating a dishwashing appliance is provided. The dishwashing appliance includes a sump, a pressure sensor mounted within the sump, a filter downstream from the pressure sensor, and a drain pump downstream from the pressure sensor. The method includes performing a drain cycle, wherein performing the drain cycle includes activating the drain pump for an activation period; detecting a pressure (P1) upstream from the drain pump during the activation period; comparing P1 to a first predetermined pressure limit (Plimit1); comparing P1 to a second predetermined pressure limit (Plimit2) when P1 is above Plimit1, wherein Plimit2 is greater than Plimit1; determining a target fill value when P1 is below Plimit2 and above Plimit1, wherein the target fill value is based on a difference between a normal fill volume and a fluid volume corresponding to P1; and initiating a fill cycle based on the target fill value.

Another aspect of the present disclosure is directed to a dishwashing appliance. The dishwashing appliance includes a cabinet and a tub positioned within the cabinet and defining a wash chamber for receipt of articles for washing. A spray assembly is positioned within the wash chamber and a drain pump in fluid communication with the wash chamber. A pressure sensor is upstream of the drain pump. A controller is in operative communication with the pressure sensor and the drain pump. The controller is configured to initiate a wash operation. The wash operation includes performing a drain cycle, wherein performing the drain cycle comprises activating the drain pump for an activation period; detecting a pressure (P1) upstream from the drain pump during the activation period; comparing P1 to a first predetermined pressure limit (Plimit1); comparing P1 to a second predetermined pressure limit (Plimit2) when P1 is above Plimit1, wherein Plimit2 is greater than Plimit1; determining a target fill value when P1 is below Plimit2 and above Plimit1, wherein the target fill value is based on a difference between a normal fill volume and a fluid volume corresponding to P1; and initiating a fill cycle based on the target fill value.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
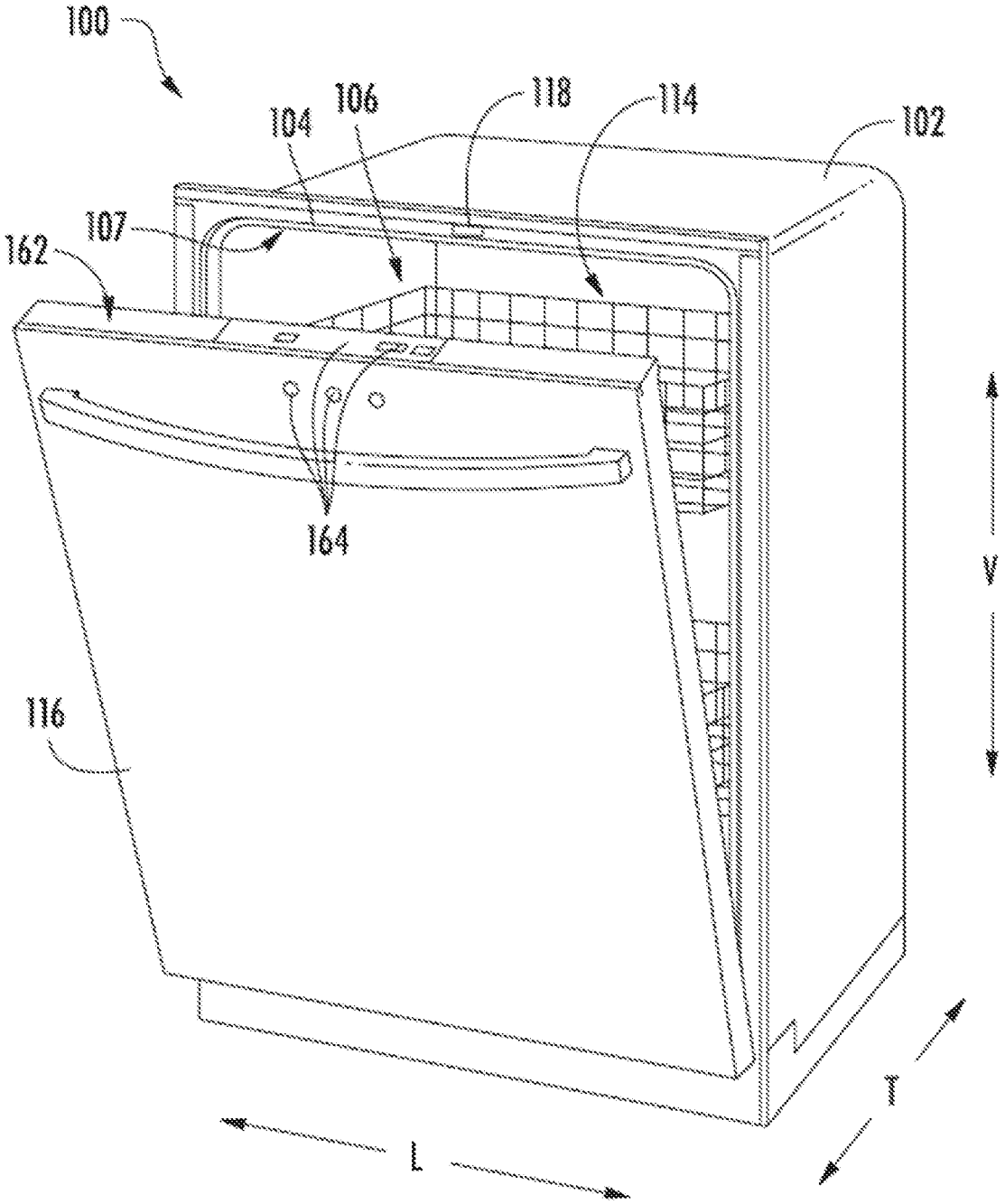
FIG. 1 provides a perspective view of an exemplary embodiment of a dishwashing appliance of the present disclosure with a door in a partially open position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For instance, "upstream" refers to the flow direction from which the fluid flows, and "downstream" refers to the flow direction to which the fluid flows. The term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a wash fluid (e.g., water, detergent, or wash additive). The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing or rinsing the articles that is typically made up of water and may include additives, such as detergent or other treatments (e.g., rinse aid). Furthermore, as used herein, terms of approximation, such as "approximately," "substantially," or "about," refer to being within a ten percent (10%) margin of error.

Thresholds and limits provided herein above or below which certain actions may be triggered may include values equal to the threshold. For instance, "above a threshold" or "above a limit" may include "equal to or above". Alternatively, "below a threshold" or "below a limit" may include "equal to or below". It should be appreciated that one skilled in the art may determine whether to include "equal to or above" or "equal to or below" as desired without deviating from the scope of the present disclosure or undue experimentation. Additionally, or alternatively, detected values, such as detected pressures, may be understood to include averages, rolling averages, trends, or other values over a period of time. Accordingly, it should be appreciated that thresholds and limits provided herein, and detection of values relative thereto, may include time constraints as may be understood by one skilled in the art and without undue experimentation.

Figure 2:
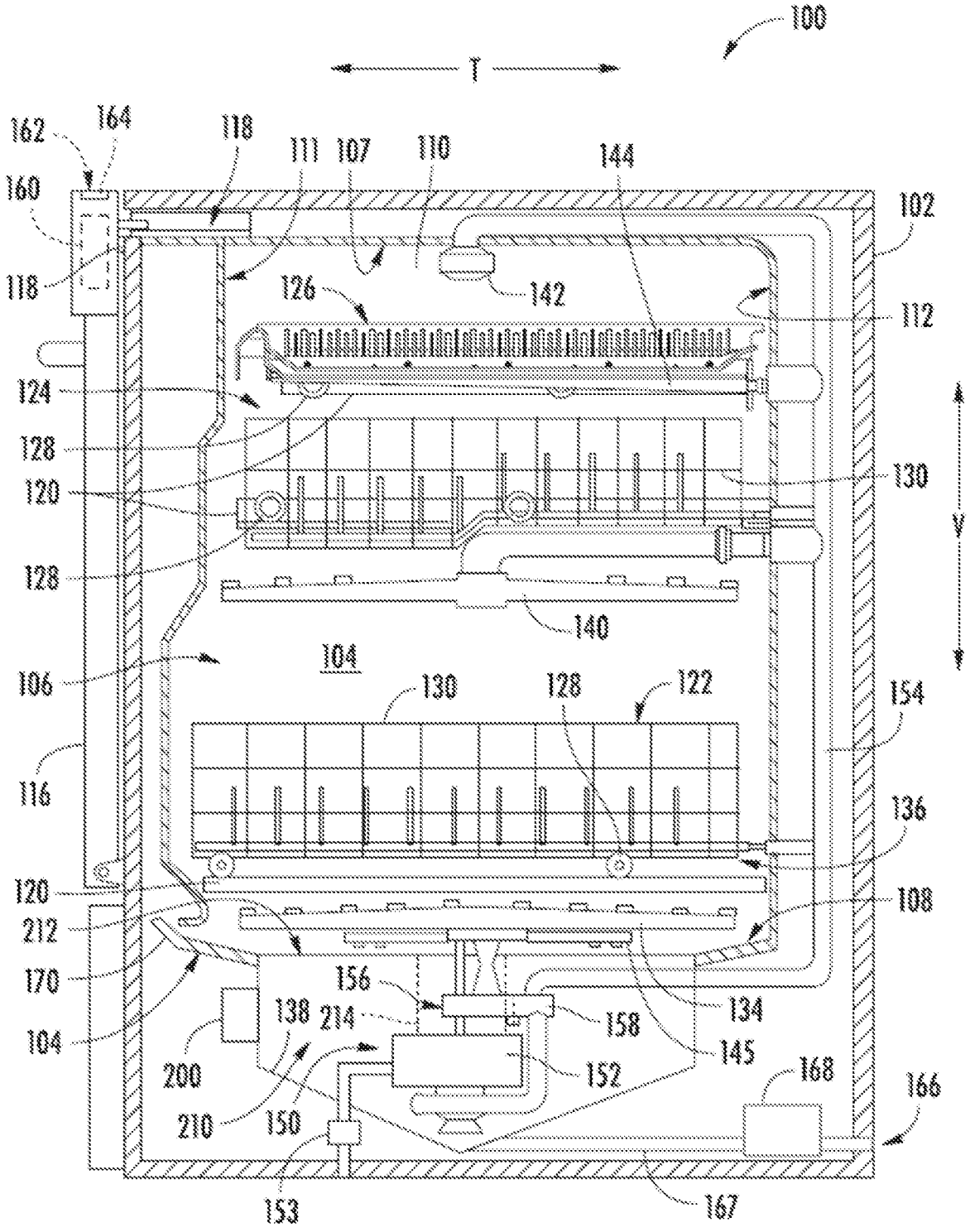
FIG. 2 provides a side, cross sectional view of the exemplary dishwashing appliance of FIG. 1.

Turning now to the figures, FIGS. 1 and 2 depict an exemplary dishwasher or dishwashing appliance (e.g., dishwashing appliance 100) that may be configured in accordance with aspects of the present disclosure. Generally, dishwasher 100 defines a vertical direction V, a lateral direction L, and a transverse direction T. Each of the vertical direction V, lateral direction L, and transverse direction T are mutually perpendicular to one another and form an orthogonal direction system.

Dishwasher 100 includes a cabinet 102 having a tub 104 therein that defines a wash chamber 106. As shown in FIG. 2, tub 104 extends between a top 107 and a bottom 108 along the vertical direction V, between a pair of side walls 110 along the lateral direction L, and between a front side 111 and a rear side 112 along the transverse direction T.

Tub 104 includes a front opening 114. In some embodiments, a door 116 hinged at its bottom for movement between a normally closed vertical position, wherein the wash chamber 106 is sealed shut for washing operation, and a horizontal open position for loading and unloading of articles from dishwasher 100. A door closure mechanism or assembly 118 may be provided to lock and unlock door 116 for accessing and sealing wash chamber 106.

In exemplary embodiments, tub side walls 110 accommodate a plurality of rack assemblies. For instance, guide rails 120 may be mounted to side walls 110 for supporting a lower rack assembly 122, a middle rack assembly 124, or an upper rack assembly 126. In some such embodiments, upper rack assembly 126 is positioned at a top portion of wash chamber 106 above middle rack assembly 124, which is positioned above lower rack assembly 122 along the vertical direction V.

Generally, each rack assembly 122, 124, 126 may be adapted for movement between an extended loading position (not shown) in which the rack is substantially positioned outside the wash chamber 106, and a retracted position (shown in FIGS. 1 and 2) in which the rack is located inside the wash chamber 106. In some embodiments, movement is facilitated, for instance, by rollers 128 mounted onto rack assemblies 122, 124, 126, respectively.

Although guide rails 120 and rollers 128 are illustrated herein as facilitating movement of the respective rack assemblies 122, 124, 126, it should be appreciated that any suitable sliding mechanism or member may be used according to alternative embodiments.

In optional embodiments, some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to additional or alternative embodiments, a silverware basket (not shown) is removably attached to a rack assembly (e.g., lower rack assembly 122), for placement of silverware, utensils, and the like, that are otherwise too small to be accommodated by the rack assembly.

Generally, dishwasher 100 includes one or more spray assemblies for urging a flow of fluid (e.g., wash fluid) onto the articles placed within wash chamber 106.

In exemplary embodiments, dishwasher 100 includes a lower spray arm assembly 134 disposed in a lower region 136 of wash chamber 106 and above a sump 138 so as to rotate in relatively close proximity to lower rack assembly 122.

In additional or alternative embodiments, a mid-level spray arm assembly 140 is located in an upper region of wash chamber 106 (e.g., below and in close proximity to middle rack assembly 124). In this regard, mid-level spray arm assembly 140 may generally be configured for urging a flow of wash fluid up through middle rack assembly 124 and upper rack assembly 126.

In further additional or alternative embodiments, an upper spray assembly 142 is located above upper rack assembly 126 along the vertical direction V. In this manner, upper spray assembly 142 may be generally configured for urging or cascading a flow of wash fluid downward over rack assemblies 122, 124, and 126.

In yet further additional or alternative embodiments, upper rack assembly 126 may further define an integral spray manifold 144. As illustrated, integral spray manifold 144 may be directed upward, and thus generally configured for urging a flow of wash fluid substantially upward along the vertical direction V through upper rack assembly 126.

In still further additional or alternative embodiments, a filter clean spray assembly 145 is disposed in a lower region 136 of wash chamber 106 (e.g., below lower spray arm assembly 134) and above a sump 138 so as to rotate in relatively close proximity to a filter assembly 210. For instance, filter clean spray assembly 145 may be directed downward to urge a flow of wash fluid across a portion of filter assembly 210 (e.g., first filter 212) or sump 138.

The various spray assemblies and manifolds described herein may be part of a fluid distribution system or fluid circulation assembly 150 for circulating wash fluid in tub 104. In certain embodiments, fluid circulation assembly 150 includes a circulation pump 152 for circulating wash fluid in tub 104. Circulation pump 152 may be located within sump 138 or within a machinery compartment located below sump 138 of tub 104.

When assembled, circulation pump 152 may be in fluid communication with an external water supply line (not shown) and sump 138. A water inlet valve 153 can be positioned between the external water supply line and circulation pump 152 (e.g., to selectively allow water to flow from the external water supply line to circulation pump 152). Additionally or alternatively, water inlet valve 153 can be positioned between the external water supply line and sump 138 (e.g., to selectively allow water to flow from the external water supply line to sump 138). During use, water inlet valve 153 may be selectively controlled to open to allow the flow of water into dishwasher 100 and may be selectively controlled to cease the flow of water into dishwasher 100. Further, fluid circulation assembly 150 may include one or more fluid conduits or circulation piping for directing wash fluid from circulation pump 152 to the various spray assemblies and manifolds. In exemplary embodiments, such as that shown in FIG. 2, a primary supply conduit 154 extends from circulation pump 152, along rear 112 of tub 104 along the vertical direction V to supply wash fluid throughout wash chamber 106.

In some embodiments, primary supply conduit 154 is used to supply wash fluid to one or more spray assemblies (e.g., to mid-level spray arm assembly 140 or upper spray assembly 142). It should be appreciated, however, that according to alternative embodiments, any other suitable plumbing configuration may be used to supply wash fluid throughout the various spray manifolds and assemblies described herein. For instance, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwashing appliance 100.

Each spray arm assembly 134, 140, 142, integral spray manifold 144, filter clean assembly 145, or other spray device may include an arrangement of discharge ports or orifices for directing wash fluid received from circulation pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray assemblies 134, 140, 142, 145 may be motor-driven, or may operate using any other suitable drive mechanism. Spray manifolds and assemblies may also be stationary. The resultant movement of the spray assemblies 134, 140, 142, 145 and the spray from fixed manifolds provides coverage of dishes and other dishwasher contents with a washing spray. Other configurations of spray assemblies may be used as well. For instance, dishwasher 100 may have additional spray assemblies for cleaning silverware, for scouring casserole dishes, for spraying pots and pans, for cleaning bottles, etc.

In some embodiments, an exemplary filter assembly 210 is provided. As shown, in exemplary embodiments, filter assembly 210 is located in the sump 138 (e.g., to filter fluid to circulation assembly 150). Generally, filter assembly 210 removes soiled particles from the fluid that is recirculated through the wash chamber 106 during operation of dishwashing appliance 100. In exemplary embodiments, filter assembly 210 includes both a first filter 212 (also referred to as a "coarse filter") and a second filter 214 (also referred to as a "fine filter").

In some embodiments, the first filter 212 is constructed as a grate having openings for filtering fluid received from wash chamber 106. The sump 138 includes a recessed portion upstream of circulation pump 152 or a drain pump 168 and over which the first filter 212 is removably received. In exemplary embodiments, the first filter 212 operates as a coarse filter having media openings in the range of about 0.030 inches to about 0.060 inches. The recessed portion may define a filtered volume wherein debris or particles have been filtered by the first filter 212 or the second filter 214.

In additional or alternative embodiments, the second filter 214 is provided upstream of circulation pump 152 or drain pump 168. Second filter 214 may be non-removable or, alternatively, may be provided as a removable cartridge positioned in a tub receptacle 216 (FIG. 4) formed in sump 138.

Figure 3:
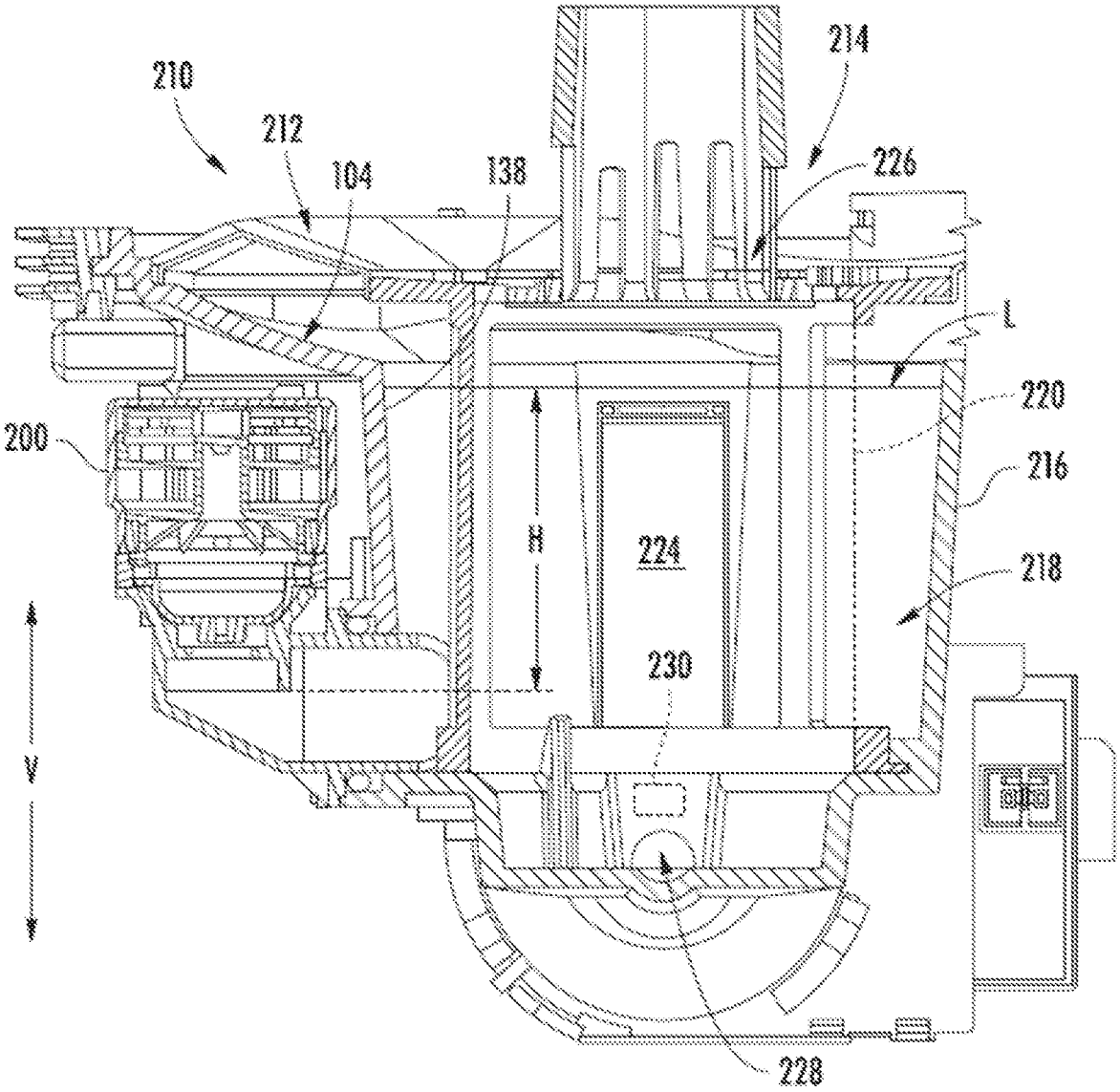
FIG. 3 provides a close up, cross sectional view of a sump and a pressure sensor of the dishwashing appliance of FIGS. 1 and 2.

For instance, turning especially to FIGS. 2 and 3, the second filter 214 may be removably positioned within a collection chamber 218 defined by tub receptacle 216. The second filter 214 may be generally shaped to complement the tub receptacle 216. For instance, the second filter 214 may include a filter wall 220 that complements the shape of the tub receptacle 216. In some embodiments, the filter wall 220 is formed from one or more fine filter media. Some such embodiments may include filter media (e.g., screen or mesh, having pore or hole sizes in the range of about 50 microns to about 600 microns).

When assembled, the filter wall 220 may have an enclosed (e.g., cylindrical) shape defining an internal chamber 224. In optional embodiments, a top portion of second filter 214 positioned above the internal chamber 224 may define one or more openings 226 (e.g., vertical flow path openings), thereby permitting fluid to flow into the internal chamber 224 without passing through the first filter 212 or the fine filter media of the filter wall 220 of the second filter 214.

Between the top portion openings 226 and drain pump 168, internal chamber 224 may define an unfiltered volume. A drain outlet 228 may be defined below the top portion openings 226 in fluid communication with internal chamber 224 and drain pump 168 (e.g., downstream of internal chamber 224 or upstream of drain pump 168).

During, for example, a drain cycle, at least a portion of wash fluid within sump 138 may generally pass into internal chamber 224 through second filter 214 (e.g., through filter wall 220 or openings 226) before flowing through drain assembly 166 and from dishwashing appliance 100.

During operation of some embodiments (e.g., during or as part of a wash cycle or rinse cycle), circulation pump 152 draws wash fluid in from sump 138 through filter assembly 210 (e.g., through first filter 212 or second filter 214). Thus, circulation pump 152 may be downstream of filter assembly 210.

In optional embodiments, circulation pump 152 urges or pumps wash fluid (e.g., from filter assembly 210) to a diverter 156. In some such embodiments, diverter 156 is positioned within sump 138 of dishwashing appliance 100). Diverter 156 may include a diverter disk (not shown) disposed within a diverter chamber 158 for selectively distributing the wash fluid to the spray arm assemblies 134, 140, 142, or other spray manifolds. For instance, the diverter disk may have a plurality of apertures that are configured to align with one or more outlet ports (not shown) at the top of diverter chamber 158. In this manner, the diverter disk may be selectively rotated to provide wash fluid to the desired spray device.

In exemplary embodiments, diverter 156 is configured for selectively distributing the flow of wash fluid from circulation pump 152 to various fluid supply conduits—only some of which are illustrated in FIG. 2 for clarity. In certain embodiments, diverter 156 includes four outlet ports (not shown) for supplying wash fluid to a first conduit for rotating lower spray arm assembly 134, a second conduit for supplying wash fluid to filter clean assembly 145, a third conduit for spraying an auxiliary rack such as the silverware rack, and a fourth conduit for supply mid-level or upper spray assemblies 140, 142 (e.g., primary supply conduit 154).

Drainage of soiled wash fluid within sump 138 may occur, for instance, through drain assembly 166 (e.g., during or as part of a drain cycle). In particular, wash fluid may exit sump 138 through a drain outlet 228 and may flow through a drain conduit 167. In some embodiments, a drain pump 168 downstream of sump 138 facilitates drainage of the soiled wash fluid by urging or pumping the wash fluid to a drain line external to dishwasher 100. Drain pump 168 may be downstream of first filter 212 or second filter 214. Additionally or alternatively, an unfiltered flow path may be defined through sump 138 to drain conduit 167 such that an unfiltered fluid flow may pass through sump 138 to drain conduit 167 without first passing through filtration media of either first filter 212 or second filter 214.

Although a separate recirculation pump 152 and drain pump 168 are described herein, it is understood that other suitable pump configurations (e.g., using only a single pump for both recirculation and draining) may be provided.

In certain embodiments, dishwasher 100 includes a controller 160 configured to regulate operation of dishwasher 100 (e.g., initiate one or more wash operations). Controller 160 may include one or more memory devices and one or more microprocessors, such as general or special purpose microprocessors operable to execute programming instructions or micro-control code associated with a wash operation that may include a wash cycle, rinse cycle, or drain cycle. The memory may represent random access memory such as DRAM, or read only memory such as ROM or FLASH. In some embodiments, the processor executes programming instructions stored in memory. The memory may be a separate component from the processor or may be included onboard within the processor. Alternatively, controller 160 may be constructed without using a microprocessor (e.g., using a combination of discrete analog or digital logic circuitry—such as switches, amplifiers, integrators, comparators, flip-flops, AND gates, and the like—to perform control functionality instead of relying upon software).

Controller 160 may be positioned in a variety of locations throughout dishwasher 100. In optional embodiments, controller 160 is located within a control panel area 162 of door 116 (e.g., as shown in FIGS. 1 and 2). Input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of dishwasher 100. In some embodiments, user interface 164 includes a general purpose I/O ("GPIO") device or functional block. In additional or alternative embodiments, user interface 164 includes input components, such as one or more of a variety of electrical, mechanical or electromechanical input devices including rotary dials, push buttons, and touch pads. In further additional or alternative embodiments, user interface 164 includes a display component, such as a digital or analog display device designed to provide operational feedback to a user. When assembled, user interface 164 may be in operative communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For instance, different locations may be provided for user interface 164, different configurations may be provided for rack assemblies 122, 124, 126, different spray arm assemblies 134, 140, 142 and spray manifold configurations may be used, and other differences may be applied while remaining within the scope of the present disclosure.

Turning especially to FIG. 3, a close up, cross sectional view of sump 138 and a pressure sensor 200 is provided. In some instances, portions of dishwasher 100 may become obstructed or clogged (e.g., at filter assembly 210). Accordingly, and in accordance with exemplary aspects of the present disclosure, dishwasher 100 utilizes outputs from pressure sensor 200 to monitor or prevent obstructions or clogs.

In some embodiments, pressure sensor 200 mounted to sump 138. For instance, pressure sensor 200 may be mounted upstream of internal chamber 224 and second filter 214. Additionally or alternatively, pressure sensor 200 may be mounted downstream of first filter 212.

Pressure sensor 200 is operatively configured to detect a liquid level L within sump 138 and communicate the liquid level L to controller 160 (FIG. 2) via one or more signals.

Thus, pressure sensor 200 and controller 160 are generally provided in operative communication.

During use, pressure sensor 200 may transmit signals to controller 160 for instance, as a frequency, as an analog signal, or in another suitable manner or form that can be received by controller 160 to detect a pressure value (e.g., as a value of relative pressure or hydrostatic pressure, such as value in units of $mmH_2O$). In certain embodiments, pressure sensor 200 is configured to sense the height H of the wash fluid above pressure sensor 200 along the vertical direction V (e.g., by detecting the pressure on pressure sensor 200).

In some embodiments, pressure sensor 200 includes a pressure plate that is generally acted on by the pressure of the wash fluid within sump 138. As the liquid level L rises, the pressure plate is pushed upward along the vertical direction V and, thus, compresses air trapped within the housing and a diaphragm of pressure sensor 200. Compression may cause the diaphragm to flex or alter its position. As a result of the pressure and consequent movement of the diaphragm, a permanent magnet attached to the diaphragm may change its position in relation to a Hall-effect transducer. The transducer delivers one or more electrical signals proportional to the magnetic field of the magnet. Optionally, the signals from pressure sensor 200 may be linearized, digitized, or amplified before being sent to controller 160 for processing. Additionally or alternatively, the pressure sensor 200 may include a printed circuit board (PCB) board to electrically connect the various electrical components of pressure sensor 200. Moreover, pressure sensor 200 can be any suitable type of sensor capable of sensing the liquid level L within dishwasher 100.

Notably, as an upstream sensor (e.g., upstream of circulation pump 152 or drain pump 168), signals from pressure sensor 200 may be used or configured for additional detections, such as detection of overfill or flood event (e.g., as would be caused by an out-of-level condition, an inlet water valve failure, or a drain pump failure) that would otherwise go undetected by a pressure sensor downstream (i.e., on the high-pressure side) of circulation pump 152 or drain pump 168.

In additional or alternative embodiments, a secondary fluid sensor 230 is provided in fluid communication between filter assembly 210 and drain outlet 228. In particular, secondary fluid sensor 230 may be downstream from second filter 214. For example, secondary fluid sensor 230 may be mounted within a portion of internal chamber 224 and configured to detect a fluid (e.g., wash fluid) level or fluid pressure within internal chamber 224. In some such embodiments, the detected fluid level detected at secondary fluid sensor 230 is independent of detected pressure at pressure sensor 200.

Generally, secondary fluid sensor 230 may be any suitable sensor configured to detect at least one predetermined fluid level within internal chamber 224. For instance, secondary fluid sensor 230 may include or be provided as a float switch, diaphragm pressure sensor, capacitive sensor, or optical sensor configured to detect fluid within internal chamber 224 (e.g., at the vertical position of secondary fluid sensor 230).

During use, secondary fluid sensor 230 may transmit signals to controller 160 for instance, as a frequency, as an analog signal, or in another suitable manner or form that can be received by controller 160. Thus, secondary fluid sensor 230 and controller 160 are generally provided in operative communication. From the signal or signal(s) received from secondary fluid sensor 230, controller 160 may be configured to determine if or how much (e.g., a height or volume of) fluid within internal chamber 224. In particular, based on one or more signals received from secondary fluid sensor 230, controller 160 may be configured to determine virtually no wash fluid is within internal chamber 224 (e.g., wash fluid within internal chamber 224 has reached a predetermined minimum level) and drain pump 168 has reached or is in a dry pump state (e.g., in which drain pump 168 is active, but no wash fluid is being drawn therethrough).

In further additional or alternative embodiments, controller 160 is configured to determine if or how much (e.g., a height or volume of) fluid is present within internal chamber 224 based on one or more signals to/from drain pump 168. For instance, controller 160 may be configured to determine an electric current (e.g., value in Amperes) at drain pump 168. Additionally or alternatively, controller 160 may determine an electric current variation (e.g., value of current variation in Amperes over time) at drain pump 168. Based on the determined current or current variation, controller 160 may be configured to determine drain pump 168 has reached or is in a dry pump state (e.g., in which drain pump 168 is active, but no wash fluid is being drawn therethrough). As an example, if a determined electric current value is less than or equal to a predetermined minimum current value, controller 160 may determine a dry pump state. As another example, if a determined electric current variation value is greater than or equal to a predetermined minimum current variation value, controller 160 may determine a dry pump state.

Figure 4:
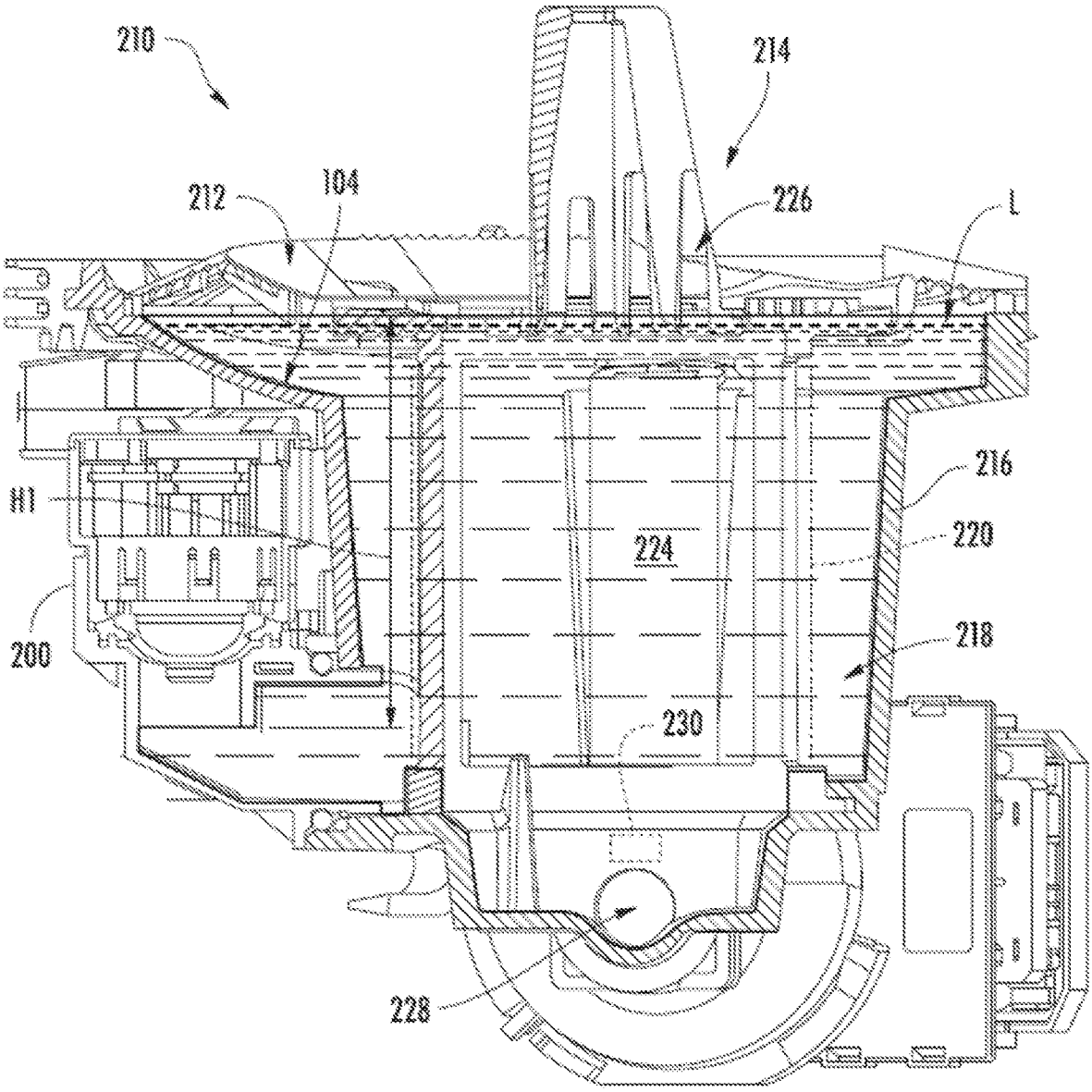
FIG. 4 provides a close up, cross sectional view of a sump and a pressure sensor in a static state.
Figure 6:
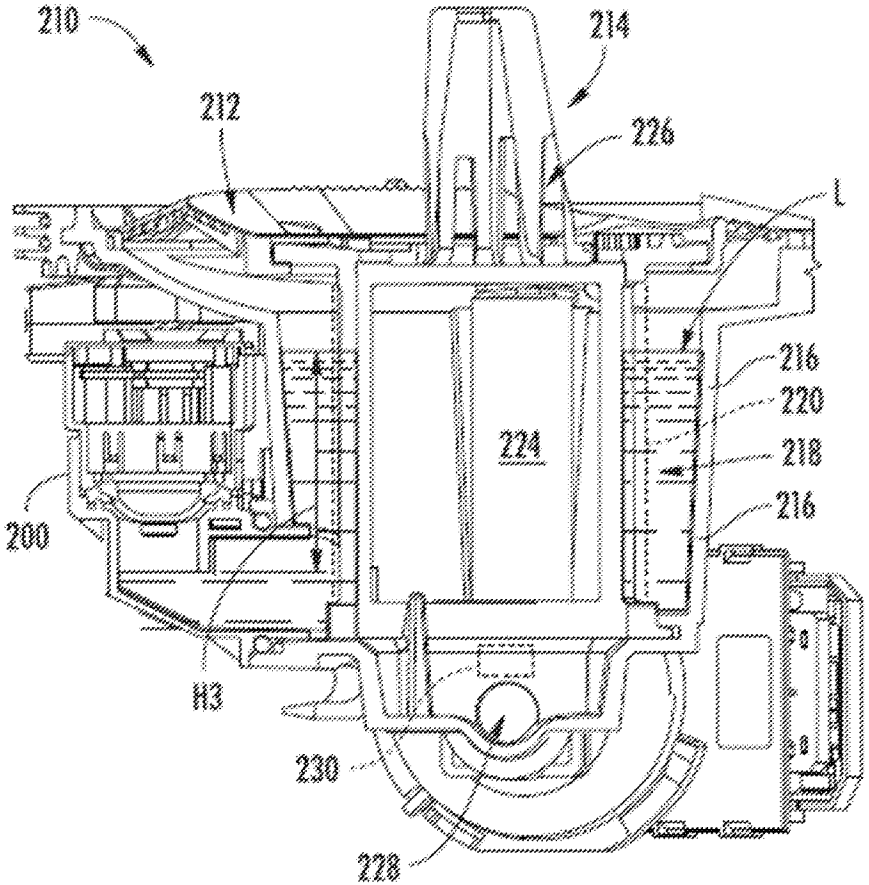
FIG. 6 provides a close up, cross sectional view of a sump and a pressure sensor in a dry pump state.
Figure 5:
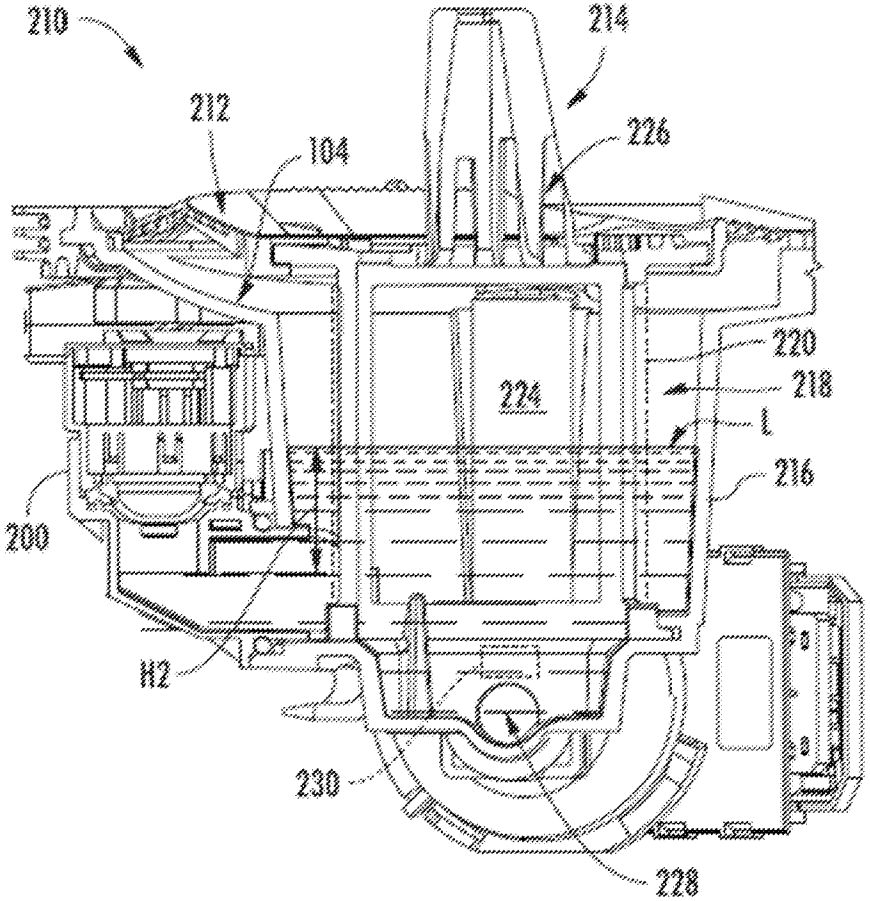
FIG. 5 provides a close up, cross sectional view of a sump and a pressure sensor in a wet pump state.

Turning especially to FIGS. 4 through 6, a portion of sump 138 is illustrated at various states. Specifically, FIG. 4 illustrates sump 138 in a static state, such as after a fill sequence, wash cycle, or rinse cycle has been performed and prior to a drain cycle. FIG. 5 illustrates sump 138 in a wet pump state, such as during a drain cycle wherein second filter 214 is generally clean and free from obstruction. FIG. 6 illustrates sump 138 in a dry pump state, such as during a drain cycle wherein second filter 214 is significantly dirty or obstructed.

As illustrated at FIG. 4, prior to a drain cycle, a volume of wash fluid is generally held within sump 138 (e.g., at a height H1 detected at pressure sensor 200). Drain pump 168 (FIG. 2) is inactive and the height is constant across sump 138 (e.g., within collection chamber 218), both within and outside of internal chamber 224. If drain pump 168 is activated while second filter 214 is generally clean, as illustrated at FIG. 5, wash fluid is drawn through drain outlet 228 and generally pulls evenly from sump 138 (e.g., within collection chamber 218). Thus, the height H2 remains constant across collection chamber 218, both within and outside of internal chamber 224. The height H2 detected by pressure sensor 200 will be consistent with the detection of wash fluid within internal chamber 224 (e.g., by secondary fluid sensor 230 or controller 160). By contrast, if drain pump 168 is activated while second filter 214 is dirty or obstructed, as illustrated at FIG. 6, wash fluid is drawn through drain outlet 228 unevenly from sump 138 (e.g., within collection chamber 218). Specifically, wash fluid is drawn first through internal chamber 224 without pulling from the region of collection chamber 218 outside of internal chamber 224. Thus, the height within internal chamber 224 will be significantly lower than the height H3 of wash fluid detected by pressure sensor 200. When the height of wash fluid within internal chamber 224 goes to zero or substantially all of the wash fluid is drawn from internal chamber 224, an inconsistent (e.g., significantly higher height H3 may be detected at pressure sensor 200). In other words, the height detected by pressure sensor 200 may be inconsistent with the detection (or absence thereof) of wash fluid within internal chamber 224 (e.g., by secondary fluid sensor 230 or controller 160).

Figure 7:
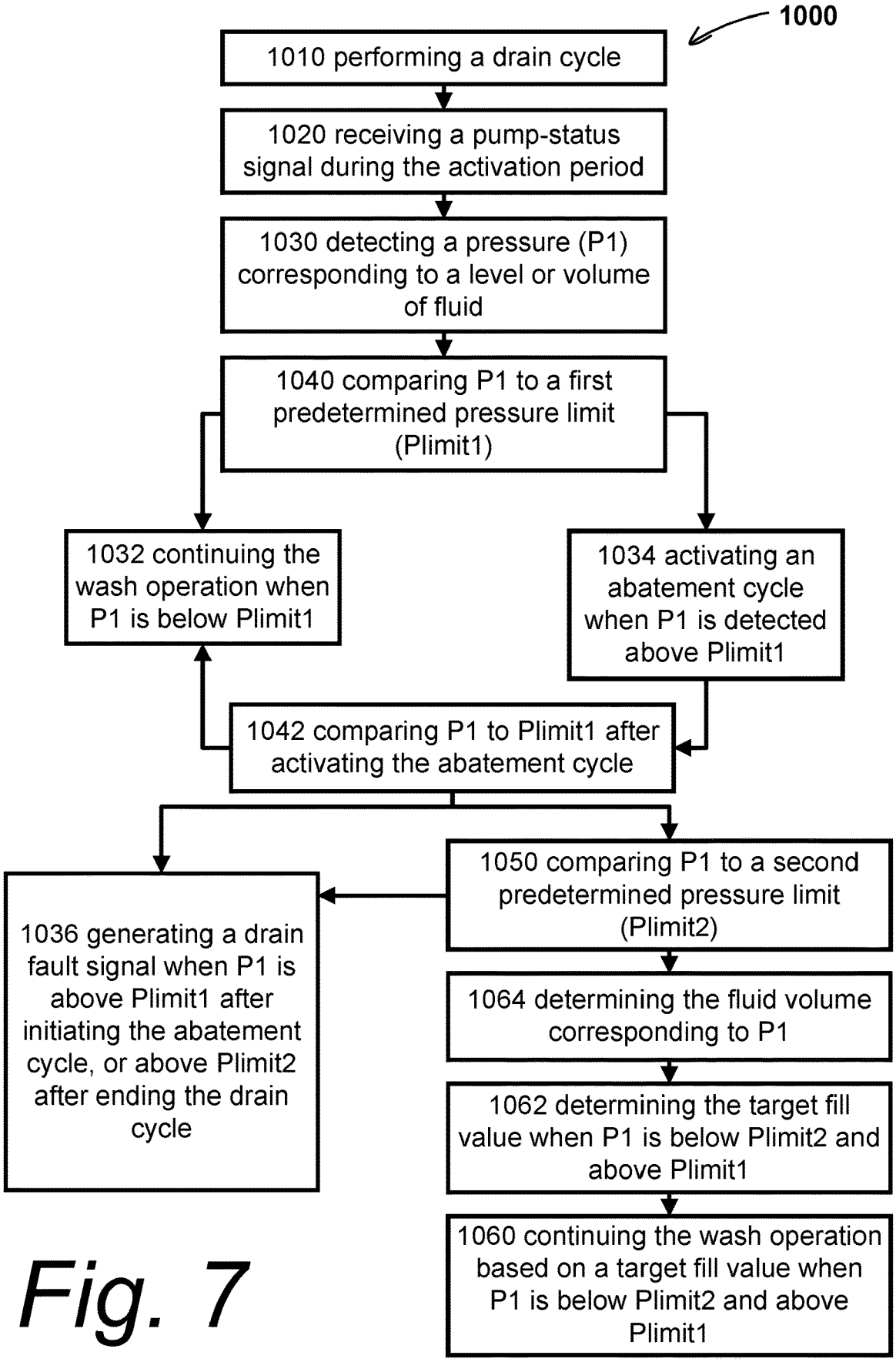
FIG. 7 provides a flowchart outlining steps of a method for operating a dishwashing appliance in accordance with aspects of the present disclosure.

Referring now to FIG. 7, a flowchart outlining steps of a method for operating a dishwashing appliance is provided (hereinafter, "method 1000"). Method 1000 may be used to operate any suitable dishwashing appliance. As an example, some or all steps of method 1000 may be used to operate dishwashing appliance 100 (FIG. 1). Controller 160 (FIG. 2) may be programmed to store and/or implement one or more steps of the method 1000 (e.g., as, or as part of, a wash operation, such as a drain cycle and/or an abatement cycle).

The method 1000 includes at 1010 performing a drain cycle. Performing the drain cycle includes activating the drain pump for an activation period. Generally, the drain pump remains active during the activation period. For instance, the drain pump may actively urge or motivate a fluid flow (e.g., the wash fluid). The activation period may be a continuous activation period such that, for a predetermined period of time, the drain pump is directed to operate uninterrupted in an attempt to motivate a substantially continuous or non-pulsated fluid flow (e.g., as in continuous flow state) through the drain conduit and out of the dishwashing appliance. In some embodiments, the activation period is programmed as a predetermined overall time period during which the drain pump remains active (e.g., maximum run time).

The method 1000 may include at 1020 receiving a pump-status signal during the activation period. For instance, the pump-status signal may be received from a secondary fluid sensor or the drain pump, as described above. Moreover, the method 1000 at 1020 may occur after the initiation of the activation period at step 1010, but while the drain pump continues to actively operate to urge or motivate a fluid flow (e.g., in a continuous flow state).

In exemplary embodiments, the pump-status signal is or includes a fluid level signal, electric current signal, or any other suitable signal for determining whether (or what level or volume of) a wash fluid is present within, for example, an internal chamber of a fine filter mounted within the sump. In some such embodiments, once the pump-status signal is received, the pump-status signal may be interpreted as a value (e.g., of fluid level, electric current, electric current variation, etc.).

The method 1000 includes at 1030 detecting a pressure (P1) corresponding to a level or volume of fluid at the sump, the collection chamber, and/or the internal chamber. Step 1030 may include detecting P1 upstream from the drain pump during the activation period. Step 1030 may include detecting P1 as a value of relative pressure in millimeters of water upstream from the drain pump. As described above, the pressure sensor (and thus the detected pressure) may also be upstream of at least a portion of the filter assembly (e.g., fine filter) or within a collection chamber.

In certain instances, P1 is detected during the activation period. Thus, P1 may be an active pumping pressure. Moreover, detecting P1 may occur after the initiation of the activation period, but while the drain pump continues to actively operate to urge or motivate a fluid flow (e.g., in a continuous flow state).

Figure 8:
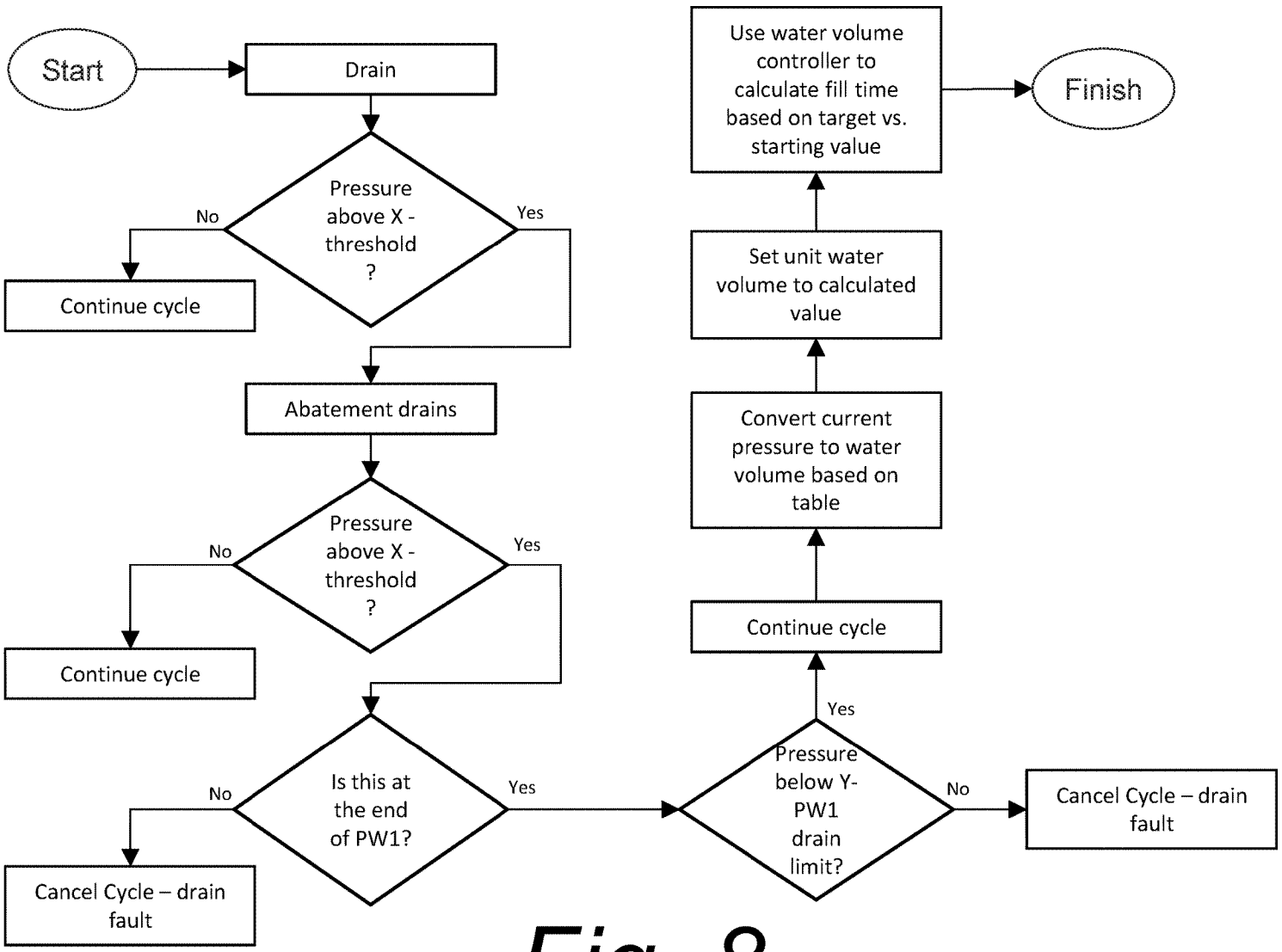
FIG. 8 provides an exemplary flow diagram illustrating a method for operating a dishwashing appliance in accordance with aspects of the present disclosure.

In a particular embodiment, the method 1000 at 1030 may include continuous or repeated detection of P1. Method 1000 includes at 1040 comparing P1 to a first predetermined pressure limit (Plimit1). Plimit1 defines a full drain threshold, denoted as "X–threshold" in FIG. 8. Plimit1 forms a first threshold corresponding to or indicative of a level or volume of fluid at or below which the drain cycle may continue to pump fluid under normal, desired conditions. Stated differently, P1 at or below Plimit1 is indicative of the filter(s) and/or pump(s) allowing for sufficient draining of fluid from the filter assembly, the collection chamber, and/or the internal chamber. When P1 is less than or below Plimit1, method 1000 may include at 1032 continuing the wash operation (e.g., continuing normal operation of the drain cycle and proceeding to other operations of the wash operation, such as rinse cycle, dry, etc.). P1 greater than or above Plimit1 is indicative of blockage, clogging, air bubbles, or other obstructions at the filter and/or pressure sensor. In particular, P1 above Plimit1 may be indicative of clogging at the fine filter.

The method 1000 may include at 1034 activating an abatement drain cycle (abatement cycle) when P1 is detected above Plimit1. The abatement cycle may include pulsing the drain pump. Thus, pulsing the drain pump may be initiated or activated, at least in part, in response to a determination that P1 is greater than Plimit1. In order for pulsing to occur, a pulsating sequence may be initiated. The pulsating sequence may include activating the drain pump for a pulsating activation period during which the drain pump is active according to a set pulsating pattern. Thus, the drain pump may draw wash fluid at an interrupted pace with sequential, discrete pulses. Wash fluid may be permitted to briefly accumulate within, for example, the internal chamber, before the drain pump draws it through the drain outlet.

In certain embodiments, the method 1000 at 1040 is performed in one or more iterations after activating or completing the abatement cycle. Accordingly, the method 1000 may include at 1041 comparing P1 to Plimit1 during the drain cycle (e.g., prior to activating the abatement cycle), such as to determine whether to activate the abatement cycle at 1034, and at 1042 comparing P1 to Plimit1 after activating the abatement cycle. The method 1000 at 1042 may include comparing P1 to Plimit1 during the abatement cycle and/or after completion of the abatement cycle.

As provided above, the method 1000 at 1030 may include continuous or repeated detection of P1. Accordingly, the method 1000 may include detecting P1 after activating the abatement cycle (e.g., during and/or after completion of the abatement cycle). The method 1000 may include performing step 1032 when P1 is below Plimit1 after performing step 1034.

In a particular embodiment, the method 1000 includes at 1036 generating a drain fault signal when P1 is above Plimit1 after initiating or activating the abatement cycle at 1034. Step 1036 may particularly include generating the drain fault signal when P1 is above Plimit1 and the drain cycle, or another appropriate cycle (e.g., pre-wash cycle) is activated, incomplete, or in operation. The method 1000 at 1036 may include generating a drain fault signal after a predetermined period of time has elapsed at which P1 is above Plimit1. Additionally, or alternatively, the method 1000 at 1036 may include generating a drain fault signal based on a rate of change or change trend of P1 after activating the abatement cycle at 1034. For instance, when P1 remains unchanged (or, based on the change trend, unsubstantially changed) for a predetermined period of time, a drain fault signal is generated, indicating to a user that one or more drains, filters, or chambers requires cleaning, manual draining, or replacement. Generating the drain fault signal at 1036 may furthermore include de-activating or stopping the wash operation, such as to mitigate flooding or damage at the dishwashing appliance.

The drain fault signal may include an audio and/or visual alert. Thus, a user may be informed that the filter(s), sump, or other portion of the appliance is in need of cleaning, de-clogging, or removing blockage. As an example, a speaker may be directed to generate an audible sound wave corresponding to the determined fault condition. As another example, a controller may direct a light source or display of the user interface to transmit a visual identifier corresponding to the determined fault condition.

The method 1000 includes at 1050 comparing P1 to a second predetermined pressure limit (Plimit2). Plimit2 defines a wash cycle drain limit, denoted as "Y–threshold" in FIG. 8. Plimit2 forms a second threshold greater than or above the first threshold defined by Plimit1. Step 1050 may particularly be performed after the drain cycle, or another appropriate cycle (e.g., pre-wash cycle) has ended. Accordingly, the method 1000 at 1036 may include generating a drain fault signal when P1 is above Plimit1 and Plimit2 after the drain cycle or another appropriate cycle (e.g., pre-wash cycle) has ended. The method 1000 includes at 1060 continuing the wash operation based on a target fill value when P1 is below Plimit2 and above Plimit1. In a particular embodiment, method 1000 at 1060 includes continuing the wash operation based on a target fill value when P1 is below Plimit2 and above Plimit1 after the drain cycle or other appropriate cycle has ended.

The method 1000 may include at 1062 determining the target fill value when P1 is below Plimit2 and above Plimit1. The target fill value is based on a difference between a normal fill volume and a fluid volume corresponding to P1. The normal fill volume is a predetermined value of fluid that may be provided into the dishwashing appliance during un-obstructed operation. In various embodiments, values above the normal fill volume may result in flooding or damage to the dishwashing appliance. The method 1000 may include determining a difference between the normal fill volume and a fluid volume determined at the internal chamber, collection chamber, fine filter, and/or one or more other filters, such as may correspond to the pressure P1 signal (e.g., step 1030) and/or the pump status signal (e.g., step 1020).

The method 1000 may include at 1064 determining the fluid volume corresponding to P1. The fluid volume may correspond to fluid remaining at the sump, chamber, filter, or closures upstream of the drain pump as may be detected by the pressure sensor(s). The fluid volume corresponding to P1 is a determined volume of fluid based on the pressure P1 detected at 1030. In certain embodiments, determining the fluid volume corresponding to P1 includes determining the fluid volume at the sump based on comparing P1 to a first volume corresponding to a minimum pressure limit (Pmin) and a second volume corresponding to a maximum pressure limit (Pmax). It should be appreciated that Plimit1 and Plimit2 are thresholds between Pmin and Pmax. The method 1000 at 1064 may accordingly include interpolating the fluid volume from known pressures and corresponding volumes. The method 1000 at 1064 may additionally, or alternatively, include comparing P1 to a lookup table, chart, schedule, function, graph, list, etc. corresponding pressure to fluid volume.

During operation of method 1000 with exemplary embodiments of the dishwashing appliance 100, one or more pressure sensors 200 measures or otherwise detects fluid pressure (e.g., at sump 138), such as provided at step 1030. During the wash operation, water levels change based on the amount of water used by each hydraulic channel, soil load, and filter clogging. During normal, desired operation during the drain cycle (e.g., at step 1010), water pressure decreases (e.g., toward Pmin) once all fluid is drained from the appliance (e.g., at step 1032). When water pressure fails to decrease such as to or below Plimit1, or furthermore fails to decrease within a desired period of time (e.g., the activation period), the appliance 100 initiates or activates an abatement cycle (e.g., at step 1034). If the abatement cycle results in the water pressure decreasing below Plimit1 (e.g., detection via step 1030 after initiating step 1034), the appliance 100 may proceed with further wash operations (e.g., wash cycle, rinse cycle, dry cycle, etc.).

If the water pressure is above Plimit1 (e.g., detection via step 1030 after initiating step 1034) and below Plimit2 (e.g., detection via step 1050), the method 1000 initiates or continues wash operation to remove blockages, clogs, or other conditions resulting in P1 detection above Plimit1. The wash operation is modified based on the target fill value by conducting further wash operation with a decreased fluid volume based on the detected P1 and corresponding volume removed from the normal fluid fill amount, such as provided with step 1062 or step 1064. The method 1000 may accordingly allow for continued usage and operation of the appliance to remove the clogging condition while mitigating flooding or damage to the appliance. The method 1000 may reduce a quantity of drain fault signals, which may require user action, disrupt the wash operation, or diminish actual or perceived appliance quality or functionality. Reduced drain fault signals may further include avoiding false drain fault signals by allowing the appliance to resolve temporary blockages or clogging that may be cleared with continued running of the appliance, while mitigating damage or flooding that may result from continued wash operation with a partially or fully clogged drain, filter, sump, etc.

In an exemplary embodiment, method 1000 implemented at appliance 100 defines Plimit2 as a pre-wash cycle 1 drain limit at approximately 60 millimeters of water, and defines Plimit1 as a full drain threshold at approximately 40 millimeters of water. The pre-wash cycle 1 may be a portion of the wash cycle configured to initially spray fluid or otherwise remove fibrous soils that may be found initially on dishes when initially commencing the wash cycle. The pre-wash cycle 1 may include spraying water, or additionally, water and a detergent, rinse fluid, or other cleaning agent. In the exemplary embodiment, the method 1000 may perform one or more of steps 1010, 1020, 1030, and 1034, such as described above.

At the end of the pre-wash cycle 1, such as after step 1034, method 1000 detects pressure P1 via step 1030. If the detected P1 is 55 millimeters of water (i.e., pressure P1 is above Plimit1 and below Plimit2), the method 1000 continues the wash operation based on a target fill value based on step 1060. The method 1000 at 1062 determines the target fill value by converting pressure P1 to fluid volume based on a stored table, etc. corresponding pressure to fluid volume. In the exemplary embodiment, the stored table may correspond 60 millimeters of water to approximately 0.15 gallons; 40 millimeters of water to approximately 0.10 gallons; 20 millimeters of water to approximately 0.05 gallons; and 0 millimeters of water to 0 gallons. Based on the stored table, the method 1000 at 1062 converts pressure P1 (detected to be approximately 55 millimeters of water) to a fluid volume of approximately 0.1375 gallons. The method 1000 at 1064 may interpolate or otherwise determine the fluid volume based on values from the stored table and detected pressure P1.

In the exemplary embodiment, if the normal fill volume for the continued wash cycle if 0.85 gallons, the method 1000 determines the target fill value as a difference between the normal fluid volume of 0.85 gallons and the determined fluid volume corresponding to P1 of approximately 0.1375 gallons. The method 1000 determines the target fill volume of approximately 0.7125 gallons and continues the wash operation by providing 0.7125 gallons rather than the normal fill volume of 0.85 gallons. The method 1000 may accordingly avoid overfilling the appliance, mitigating flooding or other damage, and/or allow continued operation of the appliance without unnecessarily generating a drain fault signal.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a dishwashing appliance comprising a sump, a washing chamber for receipt of articles for washing, a spray assembly positioned within the wash chamber, a pressure sensor mounted within the sump, a filter downstream from the pressure sensor, and a drain pump downstream from the pressure sensor, the method comprising:

performing a drain cycle of a wash operation, wherein performing the drain cycle comprises activating the drain pump for an activation period;

detecting, via the pressure sensor, a pressure (P1) upstream from the drain pump during the activation period;

comparing P1 to a first predetermined pressure limit (Plimit1);

comparing P1 to a second predetermined pressure limit (Plimit2) when P1 is above Plimit1, wherein Plimit2 is greater than Plimit1;

continuing the wash operation to a rinse cycle or dry cycle when P1 is below Plimit1;

generating a drain fault signal when P1 is above Plimit2 and Plimit1;

determining a target fill value when P1 is below Plimit2 and above Plimit1, wherein the target fill value is based on a difference between a first fill volume and a fluid volume corresponding to P1; and initiating a fill cycle based on the target fill value.

2. The method of claim 1, the method comprising:

determining the fluid volume corresponding to P1.

3. The method of claim 2, wherein determining the fluid volume corresponding to P1 comprises determining a fluid volume at the sump based on comparing P1 to a first volume corresponding to a minimum pressure limit (Pmin) and a second volume corresponding to a maximum pressure limit (Pmax).

4. The method of claim 1, wherein Plimit1 is greater than a minimum pressure limit (Pmin).

5. The method of claim 1, wherein comparing P1 to a first predetermined pressure limit (Plimit1) is during the drain cycle.

6. The method of claim 5, the method comprising:

activating an abatement cycle when P1 is above Plimit1 during the drain cycle.

7. The method of claim 6, the method comprising:

comparing P1 to Plimit1 after activating the abatement cycle; and discontinuing the drain cycle when P1 is above Plimit1 after activating the abatement cycle.

8. The method of claim 6, wherein the abatement cycle comprises pulsing the drain pump in response to determining P1 is above Plimit1.

9. The method of claim 1, wherein comparing P1 to a second predetermined pressure limit (Plimit2) when P1 is above Plimit1 is after discontinuing the drain cycle.

10. A dishwashing appliance, comprising:

a cabinet;

a tub positioned within the cabinet and defining a wash chamber for receipt of articles for washing;

a spray assembly positioned within the wash chamber;

a drain pump in fluid communication with the wash chamber;

a pressure sensor upstream of the drain pump; and a controller in operative communication with the pressure sensor and the drain pump, the controller being configured to initiate a wash operation, the wash operation comprising;

performing a drain cycle, wherein performing the drain cycle comprises activating the drain pump for an activation period;

detecting, via the pressure sensor, a pressure (P1) upstream from the drain pump during the activation period;

comparing P1 to a first predetermined pressure limit (Plimit1);

comparing P1 to a second predetermined pressure limit (Plimit2) when P1 is above Plimit1, wherein Plimit2 is greater than Plimit1;

continuing the wash operation to a rinse cycle or dry cycle when P1 is below Plimit1;

generating a drain fault signal when P1 is above Plimit2 and Plimit1;

determining a target fill value when P1 is below Plimit2 and above Plimit1, wherein the target fill value is based on a difference between a first fill volume and a fluid volume corresponding to P1; and initiating a fill cycle based on the target fill value.

11. The appliance of claim 10, the wash operation comprising:

determining the fluid volume corresponding to P1.

12. The appliance of claim 11, wherein determining the fluid volume corresponding to P1 comprises determining a fluid volume at a sump based on comparing P1 to a first volume corresponding to a minimum pressure limit (Pmin) and a second volume corresponding to a maximum pressure limit (Pmax).

13. The appliance of claim 10, wherein Plimit1 is greater than a minimum pressure limit (Pmin).

14. The appliance of claim 10, wherein comparing P1 to a first predetermined pressure limit (Plimit1) is during the drain cycle.

15. The appliance of claim 14, the wash operation comprising:

commencing an abatement cycle when P1 is above Plimit1 during the drain cycle.

16. The appliance of claim 15, the wash operation comprising:

comparing P1 to Plimit1 after commencing the abatement cycle; and discontinuing the drain cycle when P1 is above Plimit1 after commencing the abatement cycle.

17. The appliance of claim 15, wherein the abatement cycle comprises pulsing the drain pump in response to determining P1 is above Plimit1.

18. The appliance of claim 10, wherein comparing P1 to a second predetermined pressure limit (Plimit2) when P1 is above Plimit1 is after discontinuing the drain cycle.

* * * * *